US012410987B2

(12) United States Patent
Tseng

(10) Patent No.: US 12,410,987 B2
(45) Date of Patent: Sep. 9, 2025

(54) DEVICE FOR PAINTBALL AIR GUN

(71) Applicant: WORLITE INDUSTRY CO., LTD., New Taipei (TW)

(72) Inventor: Jui-Fu Tseng, New Taipei (TW)

(73) Assignee: WORLITE INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 18/396,731

(22) Filed: Dec. 27, 2023

(65) Prior Publication Data

US 2025/0216171 A1 Jul. 3, 2025

(51) Int. Cl.
*F41B 11/723* (2013.01)
*F41B 11/62* (2013.01)

(52) U.S. Cl.
CPC ..... *F41B 11/723* (2013.01); *F41B 11/62* (2013.01)

(58) Field of Classification Search
CPC ..... F41A 11/723; F41B 11/723
See application file for complete search history.

(56) References Cited

U.S. PATENT DOCUMENTS 7,841,330 B2 * 11/2010 Liao ..... F41B 11/723 124/77
8,261,728 B1 * 9/2012 Tseng ..... F41B 11/721 124/73
12,098,902 B2 * 9/2024 Dobbins ..... F41B 11/70
2010/0170492 A1 * 7/2010 Tiberius ..... F41B 11/62 124/31
2010/0199961 A1 * 8/2010 Liao ..... F41B 11/721 124/71
2010/0199963 A1 * 8/2010 Liao ..... F41B 11/723 124/75
2015/0020787 A1 * 1/2015 Tseng ..... F41B 11/00 124/73
2021/0102639 A1 * 4/2021 Wood ..... F16K 31/16
2023/0102220 A1 * 3/2023 Wood ..... F41B 11/62 124/74
2023/0349665 A1 * 11/2023 Dobbins ..... F41B 11/62
2024/0255250 A1 * 8/2024 Wing ..... F41B 11/721

FOREIGN PATENT DOCUMENTS

WO WO-2007064913 A2 * 6/2007 ..... F41B 11/723
WO WO-2008097265 A2 * 8/2008 ..... F41B 11/723

* cited by examiner

*Primary Examiner* — Jonathan C Weber
(74) *Attorney, Agent, or Firm* — Ying-Ting Chen

(57) ABSTRACT

An improved device for a paintball air gun. A sliding sleeve has a channel penetrating an inside thereof. The sliding sleeve has a rear ring sleeve covered a rear end thereof and several air holes around the rear ring sleeve. The gas enters the rear ring sleeve through the air holes around the rear ring sleeve, and presses the sliding sleeve forward and moved, and a buckle of a protruding ring located in the middle of the sliding sleeve has been released by the linkage device, so that the sliding sleeve is first pushed forward by the gas, until the sliding sleeve leaves the ring plug, and then the gas is allowed to rush into the sliding sleeve, so that the sliding sleeve and the gas inside impact the paint bullet and fly out at high speed, and then the spring brings the sliding sleeve back to an original position.

1 Claim, 9 Drawing Sheets

DEVICE FOR PAINTBALL AIR GUN

BACKGROUND OF THE PRESENT INVENTION

Field of Invention

The present invention relates to a paintball air gun, and in particular to an improved device for a paintball air gun that allows the sliding sleeve to produce large-impulse sliding.

Description of Related Arts

The conventional paintball air gun is as shown in FIG. 1. In the gun body, a linkage device of the trigger allows the gas bottle to supply air to a ring plug extending forward from a positioning block in the end chamber of the ballistic path. A sliding sleeve 40 is inserted into the front end of the ring plug. The sliding sleeve 40 has a ring sleeve sleeved on the front end thereof. A spring is sleeved on the ring sleeve and the sliding sleeve. The paint bullet has been pushed into the front end of the sliding sleeve in the ballistic path from the bullet chamber in advance. The sliding sleeve 40 has a two-stage channel 41 penetrating the inside thereof, several air holes 42 arranged at the rear end thereof, and a top piece 43 with holes concave inward arranged on the front end of the sliding sleeve 40. The gas enters the sliding sleeve 40 by the air holes, and the sliding sleeve 40 is pressed forward and moved forward, and the buckle with the protruding ring in the middle of the sliding sleeve 40 has been released by the linkage device, so that the sliding sleeve is first pushed forward by the gas, until the sliding sleeve leaves the ring plug, and then the gas rushes into the sliding sleeve, and the sliding sleeve and its internal gas impact paint bullet fly out at high speed, and then the spring brings the sliding sleeve back to its original position, wherein the sliding sleeve 40 is not easy to manufacture, and the ventilation in the sliding sleeve 40 is not smooth, the impact amount is small, and the striking force is insufficient, in order to provide the article that is more in line with the actual needs, the inventor has conducted research and development to solve the above-mentioned problems that are easily caused by conventional use.

SUMMARY OF THE PRESENT INVENTION

The main purpose of the present invention is to provide an improved device for a paintball air gun that produces a sliding sleeve structure with a large impact amount, so that the sliding sleeve has the best impact force in the ballistic path.

In order to achieve the above purpose, the structure of the present invention is: in a gun body, a linkage device of a trigger allows a gas bottle to supply air to a ring plug that extends forward from a positioning block in an end chamber of a ballistic path, wherein a sliding sleeve is sleeved into a front end of the ring plug, wherein a front ring sleeve is covered a front end of the sliding sleeve, wherein a spring is provided between the front ring sleeve and the sliding sleeve, wherein a paint bullet has been pushed into the front end of the sliding sleeve in the ballistic path from a bullet chamber in advance, wherein the sliding sleeve has a channel penetrating an inside thereof, wherein the sliding sleeve has a rear ring sleeve covered a rear end thereof and several air holes around the rear ring sleeve, wherein the gas enters the rear ring sleeve through the air holes around the rear ring sleeve, and presses the sliding sleeve forward and moved, and a buckle of a protruding ring located in the middle of the sliding sleeve has been released by the linkage device, so that the sliding sleeve is first pushed forward by the gas, until the sliding sleeve leaves the ring plug, and then the gas is allowed to rush into the sliding sleeve, so that the sliding sleeve and the gas inside impact the paint bullet and fly out at high speed, and then the spring brings the sliding sleeve back to an original position.

In order to provide esteemed examiners with a better understanding of the techniques, means, and effects adopted in the present invention to achieve the intended objectives, a preferred embodiment is hereby presented, along with detailed explanations accompanied by views. It is believed that through this, a thorough and concrete understanding of the purpose, features, and advantages of the present invention can be obtained.

DETAILED DESCRIPTION OF THE PREFERRED EMBODIMENT

Figure 1:
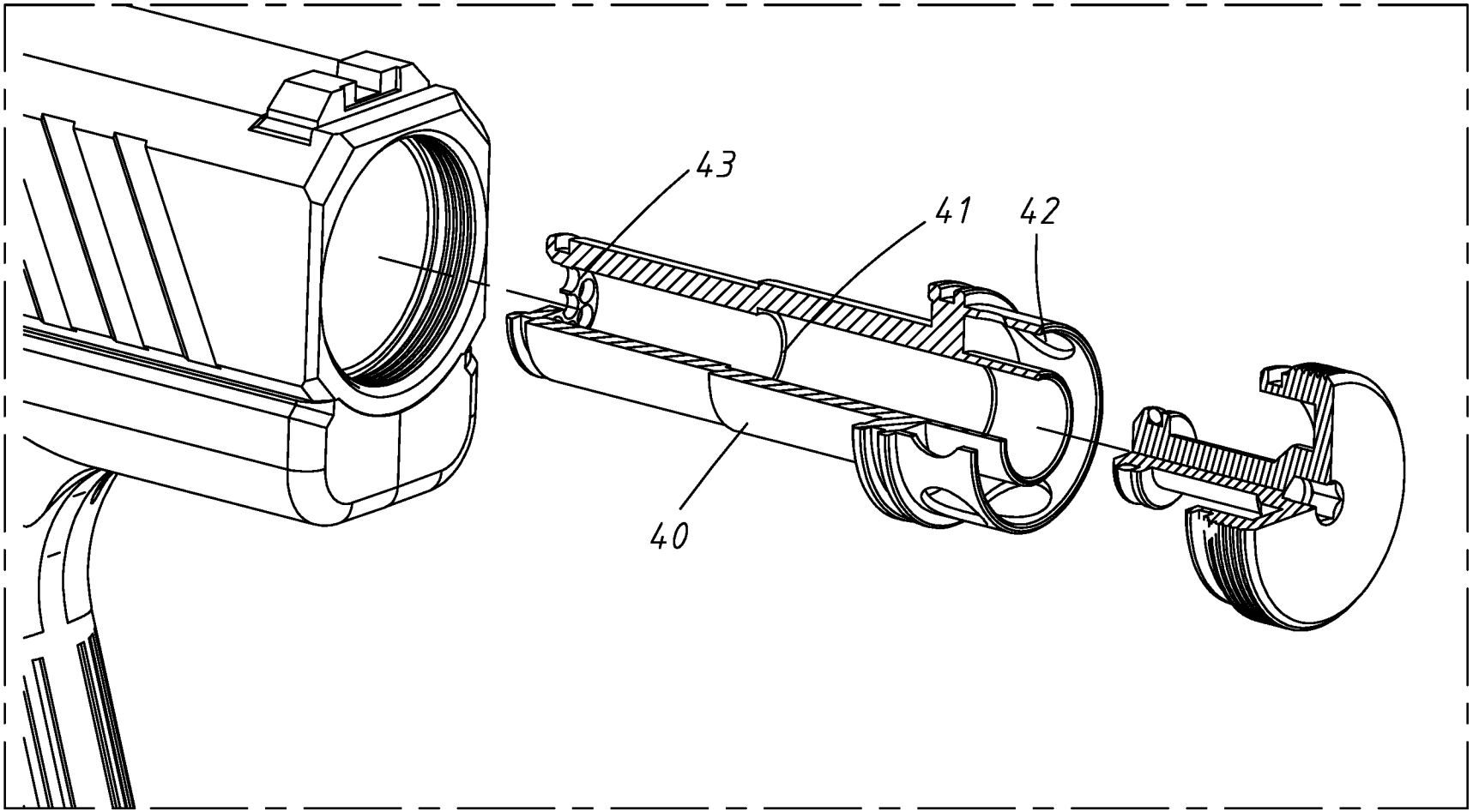
FIG. 1 (Prior Art)
FIG. 1 is a partially exploded view of the prior art.
Figure 2:
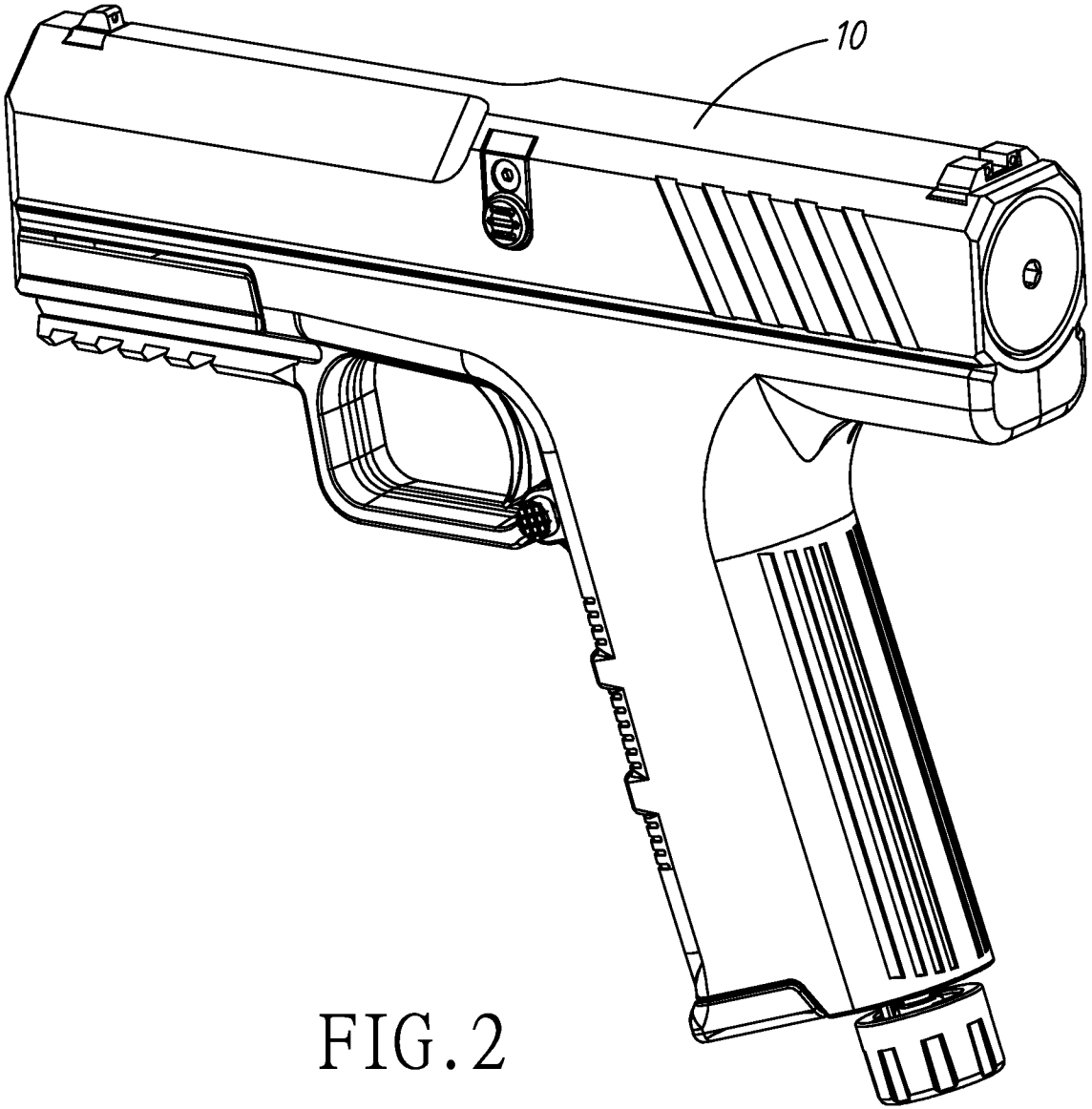
FIG. 2 is a perspective view of an embodiment of the present invention.
Figure 3:
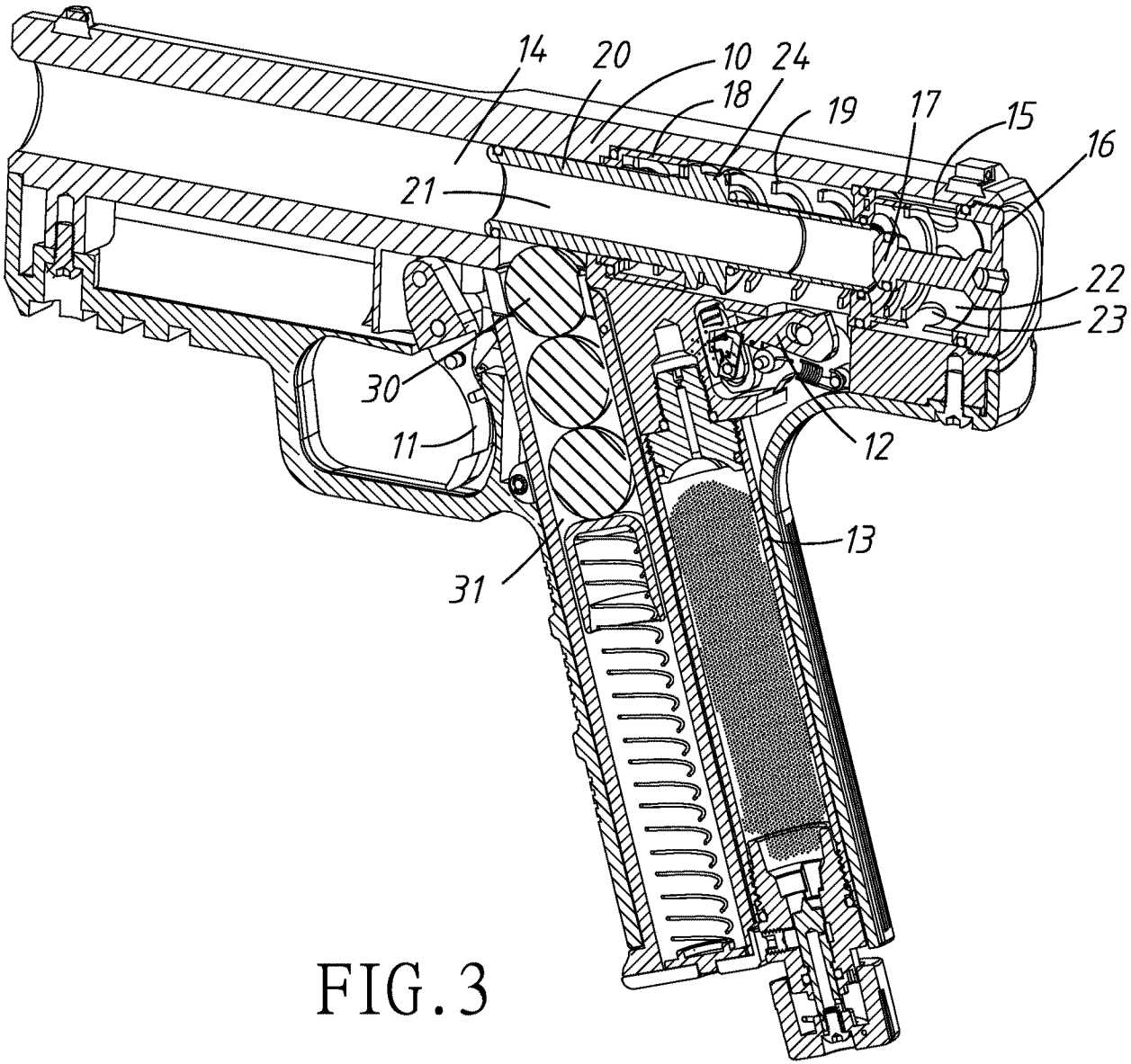
FIG. 3 is a perspective sectional view of FIG. 2 of the present invention.
Figure 4:
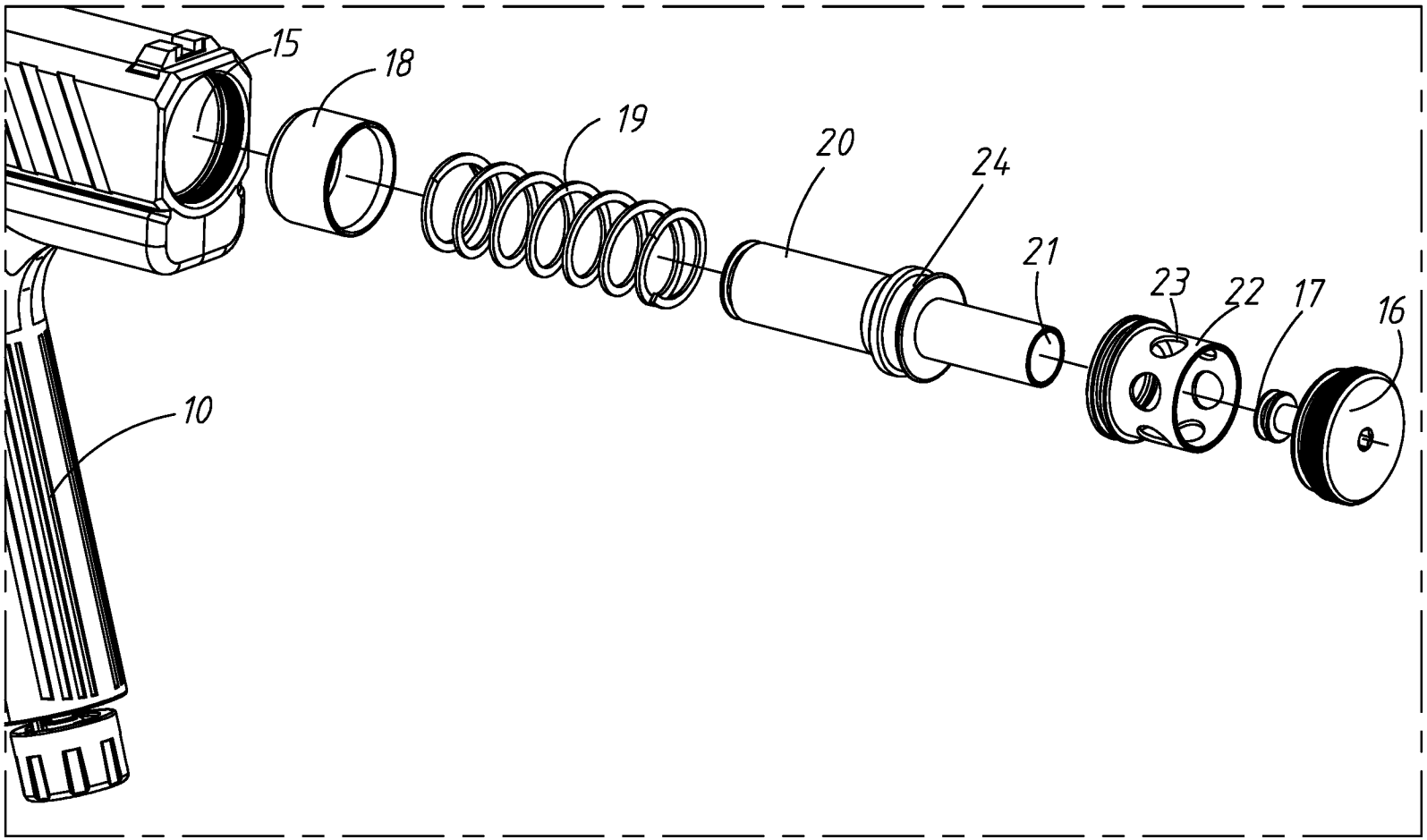
FIG. 4 is a partially exploded view of FIG. 2 of the present invention.
Figure 4A:
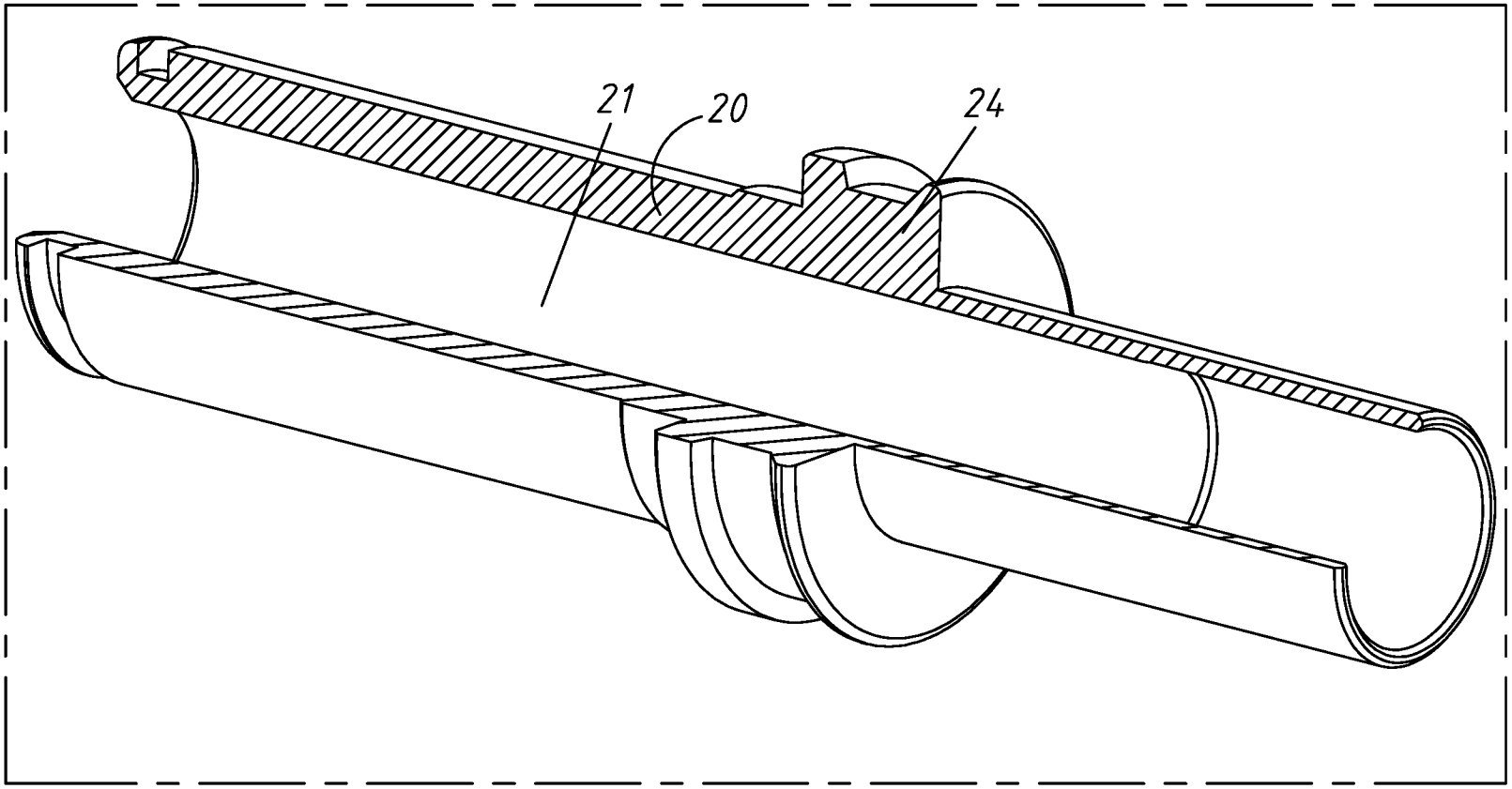
FIG. 4*a* is an enlarged view of the sliding sleeve in FIG. 4 of the present invention.
Figure 5:
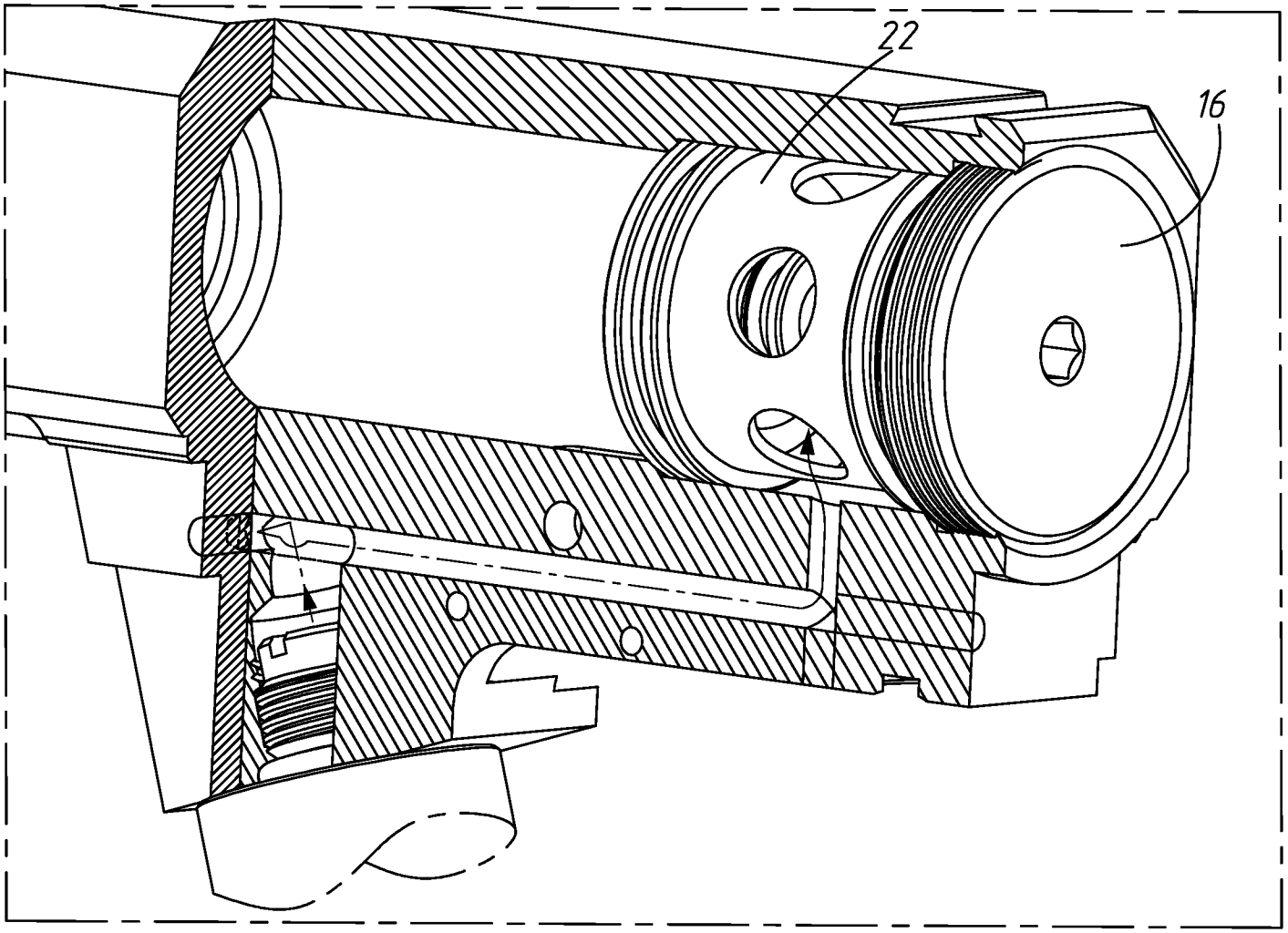
FIG. 5 is an enlarged view of the right end of FIG. 4 according to the present invention.
Figure 6:
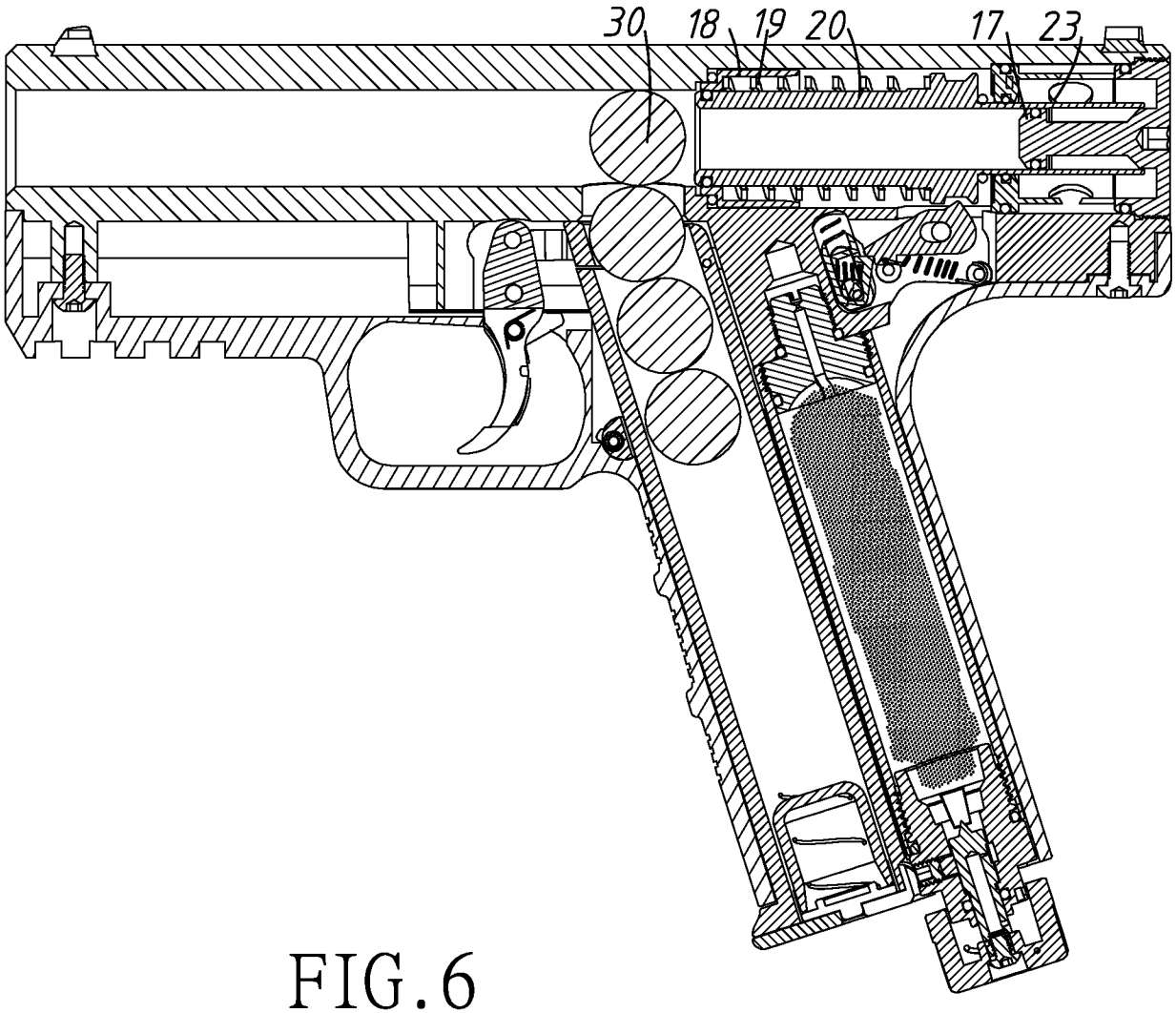
FIG. 6 is a front sectional view of FIG. 3 of the present invention.
Figure 7:
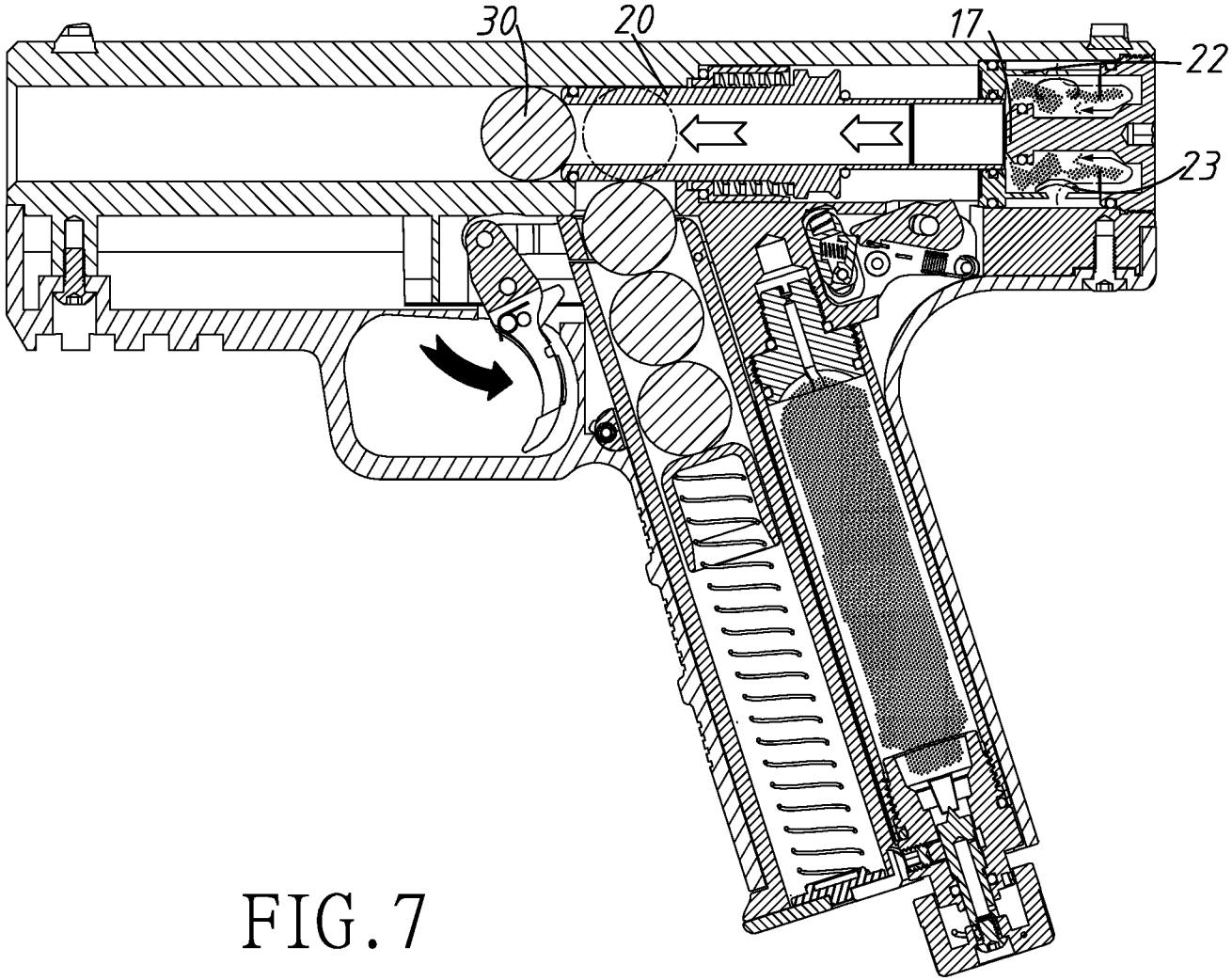
FIG. 7 is a sectional view of the sliding sleeve of FIG. 6 when the sliding sleeve is moved forward according to the present invention.
Figure 8:
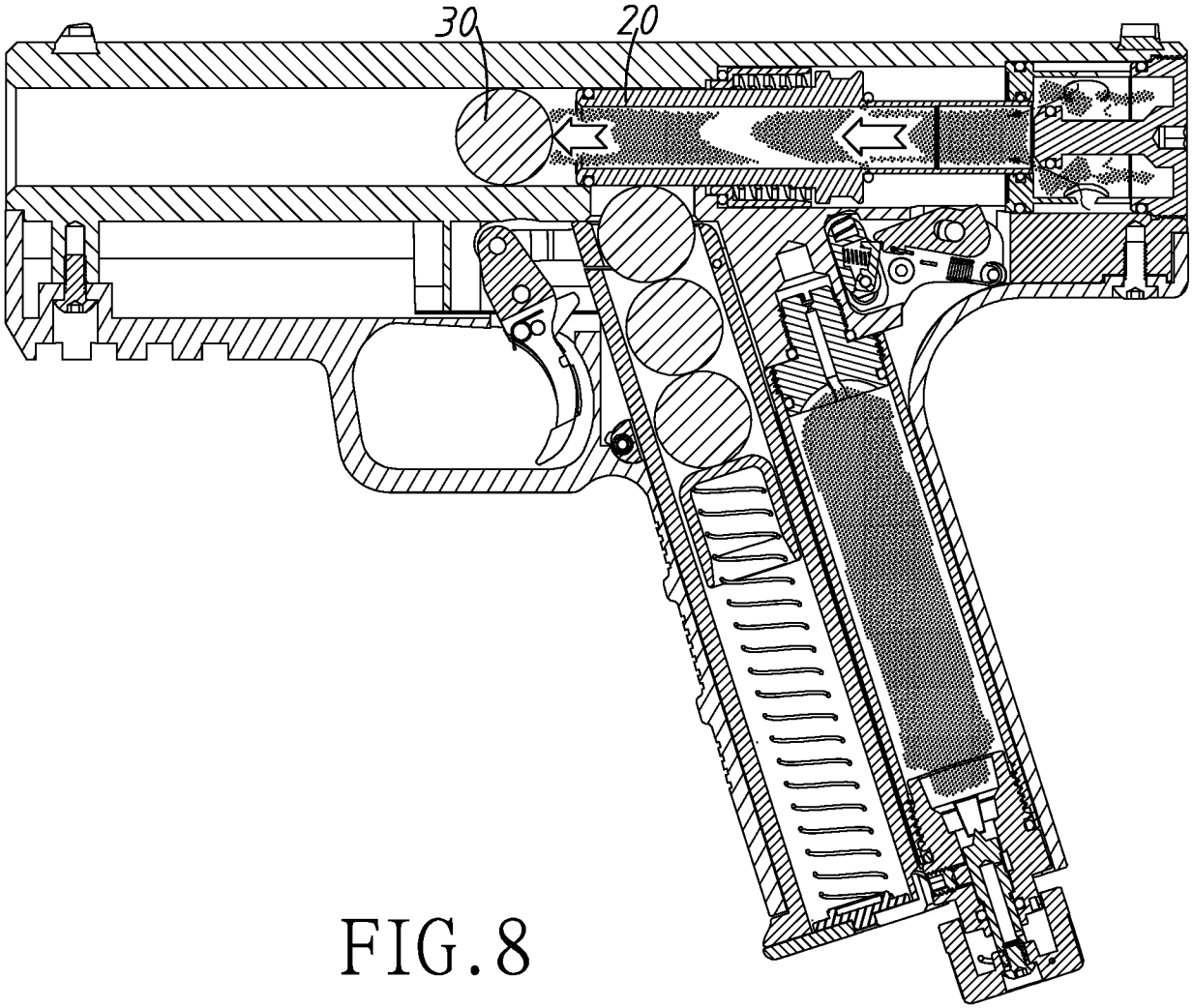
FIG. 8 is a sectional view of the gas in FIG. 7 according to the present invention when the gas rushes forward from the sliding sleeve and the sliding sleeve moves forward.

As shown in FIGS. 2 to 8, it is an improved device for a paintball air gun according to the present invention, wherein in a gun body 10 (as shown in FIG. 2), a linkage device 12 of a trigger 11 allows a gas bottle 13 to supply air to a ring plug 17 that extends forward from a positioning block 16 in an end chamber 15 of a ballistic path 14 (as shown in FIG. 5), wherein a sliding sleeve 20 is sleeved into a front end of the ring plug 17, wherein a front ring sleeve 18 is covered a front end of the sliding sleeve 20, wherein a spring 19 is provided between the front ring sleeve 18 and the sliding sleeve 20, wherein a paint bullet 30 has been pushed into the front end of the sliding sleeve 20 in the ballistic path 14 from a bullet chamber 31 in advance, wherein the sliding sleeve 20 has a channel 21 (as shown in FIGS. 4 and 4*a*) penetrating an inside thereof, wherein the sliding sleeve 20 has a rear ring sleeve 22 covered a rear end thereof and several air holes around the rear ring sleeve 22, wherein the gas enters the rear ring sleeve 22 through the air holes 23 around the rear ring sleeve 22, and presses the sliding sleeve 20 forward and moved, and a buckle of a protruding ring 24 located in the middle of the sliding sleeve 20 has been released by the linkage device 12 (as shown in FIG. 3), so that the sliding sleeve 20 is first pushed forward by the gas (as shown in FIG. 6), until the sliding sleeve 20 leaves the ring plug 17 (as shown in FIG. 7), and then the gas is allowed to rush into the sliding sleeve 20 (as shown in FIG. 8), so that the sliding sleeve 20 and the gas inside impact the paint bullet 30 and fly out at high speed, and then the spring 19 brings the sliding sleeve 20 back to an original position. The sliding sleeve 20 is allowed to slide more smoothly. Although most of them are conventional structures, the improved sliding sleeve 20 is simpler, and the sliding and impact processes are faster.

In summary, the structure described above utilizes a special design where the sliding sleeve and the rear ring sleeve are separately manufactured, making it easier. The sliding sleeve structure is simpler and produces better power, which is the easiest for people to understand and implement. Therefore, it can provide excellent usability and convenience for impact paint bullets, making it a completely different structure from what is commonly known.

The above are detailed descriptions and drawings of preferred embodiments of the present invention and are not intended to limit the present invention. The entire scope of the present invention shall be subject to the following claims, and the spirit of the patent scope and similar modified embodiments thereof and similar structures should be included in the present invention.

What is claimed is:

1. An improved device for a paintball air gun, wherein in a gun body, a linkage device of a trigger allows a gas bottle to supply air to a ring plug that extends forward from a positioning block in an end chamber of a ballistic path, wherein a sliding sleeve is sleeved into a front end of the ring plug, wherein a front ring sleeve is covering a front end of the sliding sleeve, wherein a spring is provided between the front ring sleeve and the sliding sleeve, wherein a paint bullet has been pushed into the front end of the sliding sleeve in the ballistic path from a bullet chamber in advance, wherein the sliding sleeve has a channel penetrating an inside thereof, wherein the sliding sleeve has a rear ring sleeve covering a rear end thereof and a plurality of air holes around the rear ring sleeve, wherein a buckle of a protruding ring at the middle of the sliding sleeves is released by the linkage device, and the gas enters the rear ring sleeve through the plurality of air holes of the rear ring sleeve to push the sliding sleeve forward until the sliding sleeve disengages from the ring plug, and then the gas enters the channel in the sliding sleeve to directly push the paint bullet, causing the paint bullet to exit the gun body, finally the spring returns the sliding sleeve to an original position.

* * * * *